United States Patent [19]

Graves

[11] 4,149,329

[45] Apr. 17, 1979

[54] REVERSIBLE AND FOLDABLE TAG

[76] Inventor: Jewel Graves, 14244 Carol St., Holland, Mich. 49423

[21] Appl. No.: 876,261

[22] Filed: Feb. 9, 1978

[51] Int. Cl.[2] ..... G09F 3/14

[52] U.S. Cl. ..... 40/21 R

[58] Field of Search ..... 40/5, 10 C, 2 R, 21, 40/584, 20, 306

[56] References Cited

U.S. PATENT DOCUMENTS

| | | | |
|---|---|---|---|
| 637,201 | 11/1899 | Gay | 40/23 R |
| 1,667,162 | 4/1928 | Kuhns | 40/5 X |
| 2,016,059 | 10/1935 | Stevens | 40/21 R |
| 2,554,105 | 5/1951 | Heinle | 40/10 C |
| 2,849,812 | 9/1958 | Zarges | 40/5 |
| 3,787,993 | 1/1974 | Lyon | 40/5 X |

*Primary Examiner*—Louis G. Mancene
*Assistant Examiner*—Wenceslao J. Contreras
*Attorney, Agent, or Firm*—Price, Heneveld, Huizenga & Cooper

[57] ABSTRACT

This specification discloses an identification tag for designating a container with either of two indicia. The tag includes a generally planar body which can be folded double along an axis so that either of two indicia can be displayed by reversing the fold, one of the messages being on one side and the other message being on the other side of the tag. The body of the tag can be attached to the container by an elongated strap extending from one edge of the body and passing through a pair of aligned holes in the body which are generally symetric with respect to the axis of folding. The strap has a barb-like protrusion at the end which facilitates insertion of the strap into the holes and resists removal of the strap. When the indicia is to be changed, the strap is removed from the holes, the body folded in reverse and attached to the container with the other indicia showing.

9 Claims, 6 Drawing Figures

REVERSIBLE AND FOLDABLE TAG

BACKGROUND OF THE INVENTION (1) Field of the Invention

This invention relates to identification of objects; and, more particularly, to identification of objects by either of two indicia or messages.

(2) Prior Art

It is frequently desirable to conveniently and positively label a container which is used to store, mix, or carry contents to indicate the type of material in the container. For example, many homeowners have one or more gasoline containers located in the garage, workshop or storage building. The fuel in the containers is normally stored for use in such apparatus as chain saws, autos, motorcycles, lawn mowers, snowmobiles, etc., for which the fuel is not the same and therefore can be either unmixed, that is, pure gasoline, or gasoline mixed with a petroleum or synthetic oil to provide a lubricant for an engine.

Typically, there is no convenient way to indicate whether the fuel contained in the container is mixed or unmixed gasoline. Without positive labelling it is typically difficult to know what is in the container. For example, the sequence of purchase, storage, and use of the fuel can be varied. The fuel can be mixed immediately or later, or just prior to use. Further, since most containers are not emptied immediately, some fuel remains stored in them until needed again. Often, another person other than the one who mixed or filled the container will be using the container.

If the person using the fuel in the container is not sure of just what the mixture is, the person can either guess as to the contents of the container or throw the fuel away. Guessing as to the composition of the fuel is risky because use of the fuel may damage the engine causing failure and possible injury to the operator. Depending upon the type of engine, this can happen either when the person adds additional petroleum oil or does not add any petroleum oil to the mixture in the container. Throwing away the fuel in the container is a waste of energy, a fire hazard and may cause damage to the environment.

In order to label a mixture contained within a container it would be desirable to have a very convenient tag which can indicate the contents of the container. The tag must be readily available so that it can always be used and the temptation to try to remember the contents or otherwise not label the contents is completely avoided. That is, the convenience of use of the tag must be such that the container is labelled at the moment it is filled or mixed to prevent future guesswork.

SUMMARY OF THE INVENTION

In accordance with one embodiment of this invention, a generally planar, reversible tag for designating a container with either of two messages includes a body which can be folded double along an axis either of two ways to expose either of the messages. An elongated strap extending from the body can be attached to the body through two holes extending therethrough which are spaced from the axis of folding. The body and strap form a closed loop which is used to attach the tag to the container and keep the body folded in one of two positions.

As a result, there is a single tag which can provide either of two indicia and always identify the contents of the container. The tag is very convenient to use because the action of choosing either of the indicia also doubles as a means of attaching the tag to the container. Thus, there is no need to use two different types of tags for designating two different contents of the container. Two different types of tags are much less convenient to use. Additionally, an embodiment of this invention wherein the tag has an integral strap and body permits different configurations of attaching the tag to the container to accommodate handles and containers of different sizes.

In summary, the tag provides a choice between two indicia which can readily be attached around a relatively wide range circumference sizes. An embodiment of this invention can be made relatively inexpensively and provide for a plurality of ways of attaching the tag to the container. This is particularly advantageous when the handle to be attached is either smaller or larger than the loop either formed by the strap or the body of the invention individually. In addition to labelling gas cans for such apparatus as motorcycles, lawn mowers, outboard motors, chain saws, and generators, the tag is particularly well suited for labelling a variety of products in which there are two distinct kinds, such products including such ingredients as sweetened and unsweetened food, chemicals with additives or no additives, etc.

DETAILED DESCRIPTION OF THE INVENTION

Figure 1:
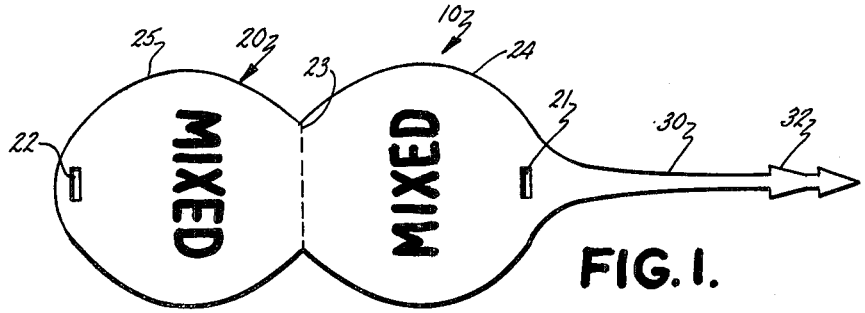
FIG. 1 is a top plan view of a tag in accordance with an embodiment of this invention.
Figure 2:
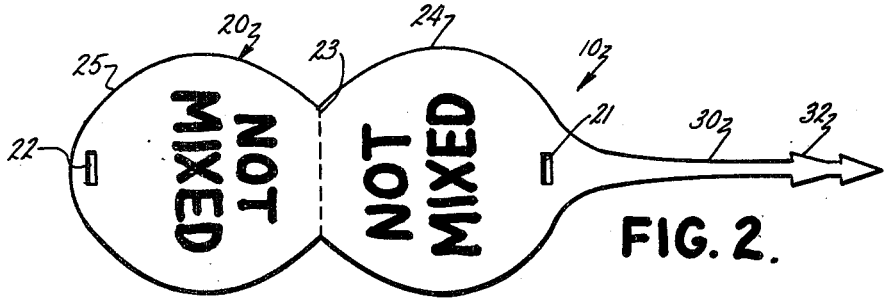
FIG. 2 is a bottom plan view of the tag of FIG. 1.

Referring to FIGS. 1 and 2, a reversible, planar identification tag 10 includes an integral body 20 and an elongated strap 30 with openings 21 and 22 through body 20. Each side 26 (FIG. 1) and 27 (FIG. 2) of body 20 has a different indicia which is selectively exposed by folding body 20 along an axis of symmetry 23 (indicated by a dotted line) and passing a portion of strap 30 through openings 21 and 22 so that body 20 remains in a folded condition. The direction of the fold along the axis of symmetry 23 determines the indicia which is displayed. To prevent strap 30 from sliding out of either opening 21 or 22, strap 30 includes barbs 32 at the end of strap 30 which will facilitate insertion of strap 30 into openings 21 and 22 but resist withdrawal of strap 30.

In the tag illustrated in FIGS. 1 and 2, the choice of indicia is between "Mixed" written on one side of tag 10 and "Not Mixed" written on the other side of tag 10. Body 20 is symmetrical about axis 23 and has the indicia written on each half. Both halves of body 20 are generally a portion of a circle with a common cord along axis of symmetry 23. A first portion 24 of body 20 on one side of axis of symmetry 23 has an opening 21 and a second portion 25 of body 20 along the other side of axis of symmetry 23 has an openng 22. Openings 21 and 22 are symmetric with respect to one another about the axis of symmetry 23 and are elongated sufficiently to pass the width of strap 30. In the embodiment shown, openings 21 and 22 are rectangular with the longitudinal axis parallel to axis of symmetry 23.

Strap 30 is an integral part of tag 10 and extends from portion 24 with a longitudinal axis perpendicular to axis 23. The extremity of strap 30 away from portion 24 includes sidewardly protruding barbs 32, having a generally arrow-head like shape. Such a configuration is particularly advantageous because tag 10 can be readily formed from a planar piece of material. A typical material is a plastic which would be resistant to the contents of the container as well as providing a good base for indelible printing of an indicia on tag 10. The number of barbs 32 can be varied as indicated by having two pair of barbs 32 in FIGS. 1 and 2 and one pair of barbs 32 in FIGS. 3–6.

FORMS OF ATTACHMENT

Referring to FIGS. 3 through 6, tag 10 can be attached to a container 11 in a plurality of ways. One of the factors to be considered is the size of the portion of container 11 to which tag 10 is to be attached. More particularly, referring to FIG. 3, strap 30 goes around the handle of container 11 so that barbs 32 extend into opening 21 first and then into opening 22. Thus, tag 10 is attached to container 11 by the closed loop of strap 30 extending from portion 24 through opening 21.

Figure 3:
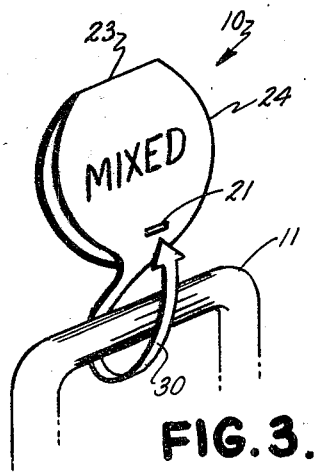
FIG. 3 is a perspective view of a tag attached to the handle of a container so that the strap enters the two holes of the body from the side where the strap is integrally attached.
Figure 4:
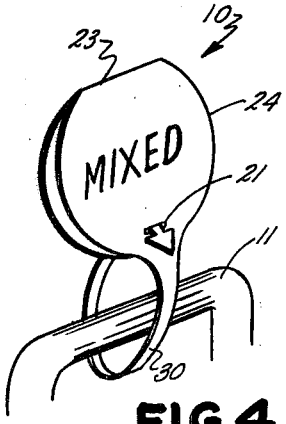
FIG. 4 is a perspective view of a tag attached to the handle of a container wherein the strap enters the two holes of the tag body from the side opposite the side to which the strap is integrally attached.

Referring to FIG. 4, the attachment of tag 10 to container 11 is similar to that of FIG. 3 with the exception that strap 30 passes through opening 22 first and then through opening 21, instead of in the reverse order.

Figure 5:
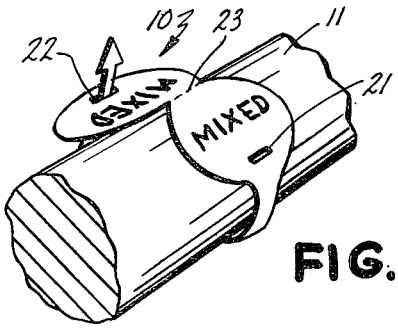
FIG. 5 is a perspective view of a larger handle wherein the end of the strap of the tag passes through only one hole of the tag thereby enlarging the closed loop formed by the tag.
Figure 6:
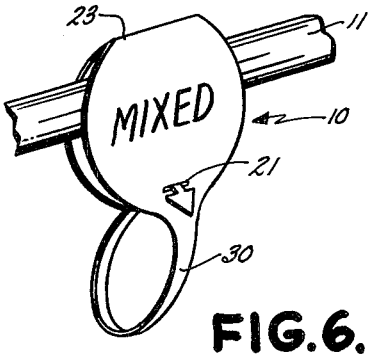
FIG. 6 shows another connection of a tag in accordance with an embodiment of this invention to a handle wherein the body of the tag surrounds the handle and the strap passes through both openings in the body.

Referring to FIG. 5, if the portion of container 11 is particularly large, barbs 32 can extend into opening 22 without entering opening 21, thus forming a closed loop including body 20 and strap 30. Nevertheless, as in the case of FIG. 3 and FIG. 4, only one of the messages on tag 10 is visible. Referring to FIG. 6, a portion of container 11 can pass between the two halves of body 20 so that barbs 32 of strap 30 pass through openings 22 and 21 and the portion of container 11 supporting tag 10 passes through the closed loop bounded by body 20 and a portion of strap 30 between openings 21 and 22.

Tag 10 is particularly advantageous because two different indicia are readily available, can be selectively exposed, and can be readily attached to a container in a variety of ways. That is, the position of the body carrying the indicia, the holes in the body and the connecting strap are arranged so that various size objects can be attached to tag 10 and only a single message of tag 10 exposed.

Various modifications and variations will no doubt occur to those skilled in the various arts to which this invention pertains. For example, the particular shape of the barb and of the body of tag 10 may be varied from that disclosed herein. These and all other variations which basically rely on the teachings through which this disclosure has advanced the art are properly considered within the scope of this invention as defined by the appended claims.

The embodiments of the invention in which an exclusive property or privilege is claimed are defined as follows:

1. A generally planar, reversible tag for designating a container with either of two indicia comprising a body having two opposed faces, one unmarked with a first indicia and the other with a second indicia, said body, being foldable to a first double folded position along an axis so only said first indicia is exposed on the outside of said tag and also foldable to a second double folded position along said axis, reverse from the first position, so only said second indicia is exposed on the outside of said tag, said body having a pair of openings therethrough which are aligned when said body is folded double in either of said two positions; said openings being spaced from said axis so they are in generally aligned positions when said body is in either of said folded positions; and an integral elongated attachment means extending from an edge of said body adjacent one of said openings, said attachment means being reusable for securing said body in either of said folded positions and forming a closed loop when coupling said openings thereby facilitating attachment of said tag to the container.

2. The tag of claim 1 in which the attachment means is a flexible strap formed integral with said body and insertably attachable in said aligned openings.

3. A tag for marking a container with either of two indicia comprising:

a body having first and second portions located on each side of an axis of symmetry and foldable toward and on each other about said axis in either of two opposite directions; each of said two portions having an opening therethrough so that the two openings are spaced from and symmetric about the axis of symmetry thereby being aligned when said body is foldable on each other; one side of said body having a first indicia and the other side of said body having a second indicia, said first indicia being visible only when said body is folded in one direction and said second indicia being visible only when said body is folded in a direction opposite to said one direction;

an elongated portion having a first end attached to one of said portions and a second end having an attachment means for attaching said second end to said body thereby forming a closed loop for securing said tag to an article.

4. The tag of claim 3 in which the attachment means is a flexible strap formed integral with said body and insertably attachable in said aligned openings.

5. A tag as recited in claim 4 in which said attachment means is configured to pass more easily through said openings in one direction when inserting said attachment means than in an opposite direction when withdrawing said attachment means.

6. A tag as recited in claim 5 wherein said attachment means includes at least one barb extending from said body.

7. A generally flexible, planar tag for marking a container with either of two indicia comprising:

a body having two integral, symmetric portions centered about a straight line axis of symmetry, a pair of openings extending through said body positioned to be symmetrical about said axis of symmetry, positioned on a line perpendicular through the center of said axis of symmetry, and positioned adjacent an edge of said body;

said body being foldable along said axis and having opposite faces of said body with different indicia means contained thereon so that when the portions are folded on each other along said axis, only a selected one of said indicia means is visible depending upon the direction in which said body is folded;

an integral strap having an elongated member with a longitudinal axis extending along said perpendicular line; said member having a portion sufficiently narrow to pass through at least one of said openings in said body so that said strap can be coupled between both of said symmetric portions, and said strap having an attachment means adjacent the extremity of said strap for attaching the extremity of said strap to said body; and said attachment means including a protrusion extending transversely outwardly from said member so that said attachment means offers greater resistance to withdrawal of said strap through one of said openings of said body than does said member offer to insertion of said strap.

8. A tag as recited in claim 7 wherein one of said two indicia appears twice on a first side of said body, once in each of said two symmetric portions, the other of said two messages appears twice on a second side of said body, once in each of said two symmetric portions.

9. A tag as recited in claim 8 wherein said attachment means includes at least one barb extending outwardly from said elongated member, said barb having a narrower width, in a direction transverse to said perpendicular line, at the extremity of said strap than at a position closer to said body, thereby facilitating insertion of said attachment means through one of said openings and resisting withdrawal of said attachment means through one of said openings.

* * * * *